US011707147B2

(12) United States Patent
Miller et al.

(10) Patent No.: US 11,707,147 B2
(45) Date of Patent: Jul. 25, 2023

(54) GARMENT HANGER

(71) Applicants: Corrie B. Miller, Honolulu, HI (US); Matthew J. Miller, Honolulu, HI (US)

(72) Inventors: Corrie B. Miller, Honolulu, HI (US); Matthew J. Miller, Honolulu, HI (US)

( * ) Notice: Subject to any disclaimer, the term of this patent is extended or adjusted under 35 U.S.C. 154(b) by 0 days.

(21) Appl. No.: 17/575,535

(22) Filed: Jan. 13, 2022

(65) Prior Publication Data

US 2022/0240701 A1 Aug. 4, 2022

Related U.S. Application Data

(60) Provisional application No. 63/137,062, filed on Jan. 13, 2021.

(51) Int. Cl.
*A47G 25/32* (2006.01)
*A47G 25/40* (2006.01)

(52) U.S. Cl.
CPC ..... *A47G 25/32* (2013.01); *A47G 25/40* (2013.01)

(58) Field of Classification Search
CPC ..... A47G 25/14–40
See application file for complete search history.

(56) References Cited

U.S. PATENT DOCUMENTS 2,745,579 A 4/1955 Goodman
3,870,206 A * 3/1975 Feinberg ..... A47G 25/32 248/340
4,168,791 A * 9/1979 Clark, Jr. ..... A47G 25/50 223/94
4,932,571 A * 6/1990 Blanchard ..... A47G 25/16 223/89
5,893,493 A 4/1999 Noiray
7,374,070 B2 5/2008 Dikes
D579,749 S 11/2008 Jou
7,837,074 B2 11/2010 Rude
(Continued)

FOREIGN PATENT DOCUMENTS

EP 3222171 A1 * 9/2017 ..... A47G 25/32
WO WO-2020002916 A1 * 1/2020 ..... A47G 25/1428

OTHER PUBLICATIONS

Top China Supplier Plastic Bikini Bra Underwear Hanger With Clips, at: "https://www.topchinasupplier.com/wholesale/China-Blue-White-Custom-Plastic-Bikini-Bra-Underwear-Hanger-with-Clips_528911/" Date unknown, Author unknown.
(Continued)

*Primary Examiner* — Ismael Izaguirre

(57) ABSTRACT

A garment hanger for holding a garment has body having a top portion with a first shoulder portion and a second shoulder portion. A hooking member includes an arm that extends away from the body to a hook that can be hooked on an object, such as a bar. A connection mechanism that connects the hooking member to the body includes a hinge mechanism that allows the hooking member to be rotated towards and away from the body so that the garment hanger can be moved from an unfolded configuration to a folded configuration. The garment hanger can also include one or more protrusions on the body that can engage a notch to secure the hooking member in the folded configuration and/or to allow for cascading of a plurality of garment hangers. In one version, the garment hanger is designed to hold swimwear.

20 Claims, 5 Drawing Sheets

(56) References Cited

U.S. PATENT DOCUMENTS

| | | | | |
|---|---|---|---|---|
| 9,113,736 | B1 * | 8/2015 | Antler | A47G 25/32 |
| 2007/0241143 | A1 | 10/2007 | Box | |
| 2009/0283556 | A1 | 11/2009 | Ho | |
| 2014/0158724 | A1 * | 6/2014 | Merandi | A47F 7/19 29/428 |

OTHER PUBLICATIONS

SN Hanger products, at "https://www.snhanger.com/products.html" Date unknown, Author unknown.

Alibab Rose Gold Bra Underwear Bikini Hangers at: "https://www.alibaba.com/product-detail/Rose-golden-Bra-Underwear-Bikini-Hangers_1600416331005.html?spm=a2700.galleryofferlist.normal_offer.d_title.655c500dPoxwNw" Date unknown, Author unknown.

Amazon NAHANCO BSH12-50 12"Chrome-Plated Bikini Hanger at https://www.amazon.com/NAHANCO-BSH12-50-Chrome-Plated-Bikini-Hanger/dp/B01NA6FVGC" Date unknown, Author unknown.

Spearmint Love, Wolf & Rita Josefina Bikini Swimsuit, Boats & Roads at "https://spearmintlove.com/products/wolf-rita-josefina-bikini-swimsuit-boats-roads?_pos=1&_sid=881596b72&_ss=r" Date unknown, Author unknown.

Curtsy App, Billabong Bikini Top at "https://curtsyapp.com/item/billabong-bikini-top/rHA2blUiuX" Date unknown, Author unknown.

Pinterest, Black Plastic Suit Hanger at "https://www.pinterest.co.uk/pin/black-slim-suit-hanger-nonslip--457256168413640798/" Date unknown, Author unknown.

Pinterest, Hanger Connector at "https://www.pinterest.co.uk/pin/4-hanger-connector-black-100mm--457256168413641082/" Date unknown, Author unknown.

Pinterest, Hanger Connector at "https://www.pinterest.co.uk/pin/space-saving-hanger-connectors--457256168413556134/" Date unknown, Author unknown.

Walmart, Ollieroo Clothing Hangers at "https://www.walmart.com/ip/Ollieroo-50PK-Heavy-Duty-Cascade-Hangers-Set-Steel-Swivel-Hooks-Ultra-Thin-Non-slip-Velvet-Coat-Hangers-Suit-Hangers-Set-Purple/185988912" Date unknown, Author unknown.

* cited by examiner

GARMENT HANGER

PRIORITY

The present application claims the benefit of domestic priority based on U.S. Provisional Patent Application 63/137,062 filed on Jan. 13, 2021, the entirety of which is incorporated herein by reference.

BACKGROUND

For as long as there have been clothes to wear, humans have struggled with storing, maintaining, displaying, and drying their articles of clothing.

Clothes hangers, coat hangers, and other types of garment hangers have been around for centuries. The modern wire-based hanger where a pair of shoulder portions flank a central hook is believed to have been first introduced in the middle of the nineteenth century. The shoulder portions mimic human shoulders and allow a garment, such as a shirt or a jacket, to the draped over or be otherwise secured to at least one of the shoulders. The hook allows the hanger and any garment hanging on the hanger to be hooked onto a rail, hook, or the like. Sometimes, a cross bar portion can be provided to connect the shoulder portions in a manner that allows an additional garment, such as pants, to be positioned on the cross bar. Today's garment hangers are often still made of wire, but many other materials, such as wood, plastic, foam, rubber, and cardboard are commonly used in conjunction with or in place of the wire.

While useful for easily storing and/or displaying many types of garments, conventional garment hangers suffer from a variety of problems or inconveniences. For example, some garment hangers include spring-loaded, often metal clips to provide additional options for hanging garments. However, these clips can damage the garment and are not ideal for hanging garments when the garments are wet. Also, conventional garment hangers often come in awkward shapes and designs that make them difficult to store and/or difficult to display garments when not being hung by the hook. In addition, conventional garment hangers are not ideal for cascading displays or storage where one garment hanger hangs from another and do not allow for easily selected options when doing so. Furthermore, conventional garment hangers are often difficult to use when holding particular types of garments. For example, conventional garment hangers are not well adapted to holding swim suits and undergarments, particularly women's two-piece swim suits and undergarment sets and are not adapted to help secure excess strings and the like that are associated with such garments.

There is therefore a need for an improved garment hanger. There is a further need for a garment hanger that is easily storable. There is a further need for a garment hanger that can be used to display a garment in a hanging condition or an unhanging position. There is a further need for a garment hanger that is conveniently useable in a cascading configuration. There is a further need for a garment hanger that is useable in a cascading configuration in multiple configurations. There is a further need for a garment hanger that is designed to hold a swim suit or undergarment. There is a further need for a garment hanger that is designed to hold a two-piece swim suit or undergarment set. There is a further need for a garment hanger that is designed to help manage the strings of a swimsuit or undergarment. There is a further need for a garment hanger that can hold a garment in a manner that allows airflow to facilitate drying when wet.

SUMMARY

The present invention satisfies these needs. In one aspect of the invention, an improved garment hanger is provided.

In another aspect of the invention, a garment hanger is designed to display, store, organize, or dry a garment such as swimsuit or undergarment.

In another aspect of the invention, a garment hanger is designed to display, store, organize, or dry a garment such as two-piece swimsuit or undergarment.

In another aspect of the invention, a garment hanger designed to display, store, organize, or dry a garment comprises a body that includes one or more features that help facilitate the holding of a garment on the garment hanger, a hooking member, and a folding mechanism.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body about a hinge axis that is generally parallel to a line connecting a first shoulder portion and a second shoulder portion and/or is generally perpendicular to a bar when the garment hanger is hooked onto the bar.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body by an angle ranging from at least about 10 degrees to about 180 degrees.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body by about 180 degrees so that the hooking member can lie against or nearly against the body.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body by about 180 degrees so that the hooking member can lie against or nearly against the body, wherein the the garment hanger includes a securing mechanism that helps maintain the garment hanger in one or both of the unfolded configuration and the folded configuration.

In another aspect of the invention, a garment hanger designed to display, store, organize, or dry a garment comprises a body that includes one or more features that help facilitate the holding of a garment on the garment hanger, a hooking member, and a folding mechanism, wherein the folding mechanism includes a hinge mechanism designed to allow the arm hooking member to rotate relative to the body by about 180 degrees so that the hooking member can lie against or nearly against the body, wherein the garment hanger includes a securing mechanism that helps maintain the garment hanger on one or both of the unfolded configuration and the folded configuration, and wherein the garment hanger includes a notch on the bottom surface of a hook, the notch being receivable on, around, or over a protrusion or peg on the body when in the folded configuration.

In another aspect of the invention, a garment hanger system comprises a plurality of garment hangers each designed to display, store, organize, or dry a garment such as swimsuit or undergarment.

In another aspect of the invention, a garment hanger system comprises a plurality of garment hangers, wherein the garment hanger can hang from one another in a cascading configuration.

In another aspect of the invention, a garment hanger system comprises a plurality of garment hangers, wherein the garment hanger can hang from one another in a first cascading configuration and in a second cascading configuration.

In another aspect of the invention, a garment hanger system comprises a plurality of garment hangers, wherein the garment hanger can hang from one another in a cascading configuration, wherein a cascading system includes the notch in a hook and a protrusion on the body.

In another aspect of the invention, a garment hanger system comprises a plurality of garment hangers, wherein the garment hanger can hang from one another in a cascading configuration, wherein a cascading system includes the notch in a hook and a protrusion on the body.

In another aspect of the invention, a garment hanger system comprises a plurality of garment hangers, wherein the garment hanger can hang from one another in a cascading configuration, wherein a cascading system includes the notch in a hook, a first protrusion on the body, and a second protrusion on the body.

In another aspect of the invention, a garment hanger system comprises a plurality of garment hangers, wherein the garment hanger can hang from one another in a cascading configuration, wherein a cascading system includes the notch in a hook and a protrusion on the body, and wherein at least one of the plurality of garment hangers comprises hooking member that can be folded into a folded configuration.

In another aspect of the invention, a garment hanger system comprises a plurality of garment hangers, wherein the garment hanger can hang from one another in a cascading configuration, wherein a cascading system includes the notch in a hook and a protrusion on the body, and wherein at least one of the plurality of garment hangers comprises hooking member that can be folded into a folded configuration and wherein the hook can cooperate with the protrusion when in the folded configuration.

In another aspect of the invention, a garment hanger designed to display, store, organize, or dry a garment comprises a body that includes one or more features that help facilitate the holding of a swimsuit or undergarment on the garment hanger.

In another aspect of the invention, a garment hanger designed to display, store, organize, or dry a garment comprises a body that includes one or more features that help facilitate the holding of a two-piece swimsuit or undergarment on the garment hanger, wherein the one or more features comprises a pair of bottom piece slots.

In another aspect of the invention, a garment hanger designed to display, store, organize, or dry a garment comprises a body that includes one or more features that help facilitate the holding of a two-piece swimsuit or undergarment on the garment hanger, wherein the one or more features comprises a pair of top piece slots.

In another aspect of the invention, a garment hanger designed to display, store, organize, or dry a garment comprises a body that includes one or more features that help facilitate the holding of a two-piece swimsuit or undergarment on the garment hanger, wherein the one or more features comprises a pair of bottom piece slots and a pair of top piece slots.

In another aspect of the invention, a garment hanger designed to display, store, organize, or dry a garment comprises a body that includes one or more features that help facilitate the holding of a swimsuit or undergarment on the garment hanger, wherein the one or more features comprises string organizing member.

In another aspect of the invention, a storage system is provided for storing a plurality of garment hangers, each folded into its folded configuration and stored side by side.

In another aspect of the invention, a storage system is provided for storing a plurality of garment hangers, each folded into its folded configuration and stored side by side, wherein each garment hanger includes a hanging system that includes a pair recesses positioned to be suspendable on rails.

In another aspect of the invention, a garment hanger adapted to hold a garment comprises a body having a top portion comprising a first shoulder portion and a second shoulder portion; a hooking member including an arm that extends away from the body to a hook that can be hooked on an object; and a connection mechanism that connects the hooking member to the body, the connection mechanism comprising a hinge mechanism that allows the hooking member to be rotated towards and away from the body.

In another aspect of the invention, a garment hanger adapted to hold a garment comprises a body having a top portion comprising a first shoulder portion, a second shoulder portion, and a protrusion; a hooking member including an arm that extends away from the body to a hook that can be hooked on an object, the hooking member including a notch; and a connection mechanism that connects the hooking member to the body, wherein the notch and protrusion are sized and shaped to be engageable with one another.

In another aspect of the invention, a method of hanging a garment from a garment hanger comprises providing a garment hanger comprising a body having a top portion comprising a first shoulder portion and a second shoulder portion; a hooking member including an arm that extends away from the body to a hook that can be hooked on an object; and a connection mechanism that connects the hooking member to the body, the connection mechanism comprising a hinge mechanism that allows the hooking member to be rotated towards and away from the body; draping a garment over the first shoulder portion and second shoulder portion; hanging the garment hanger from an object by engaging the object with the hook; removing the garment hanger from the object; and folding the garment hanger by rotating the hooking member relative to the body.

In another aspect of the invention, a method of hanging a garment from a garment hanger comprises providing a garment hanger comprising a body having a top portion comprising a first shoulder portion and a second shoulder portion; a hooking member including an arm that extends away from the body to a hook that can be hooked on an object; and a connection mechanism that connects the hooking member to the body, the connection mechanism comprising a hinge mechanism that allows the hooking member to be rotated towards and away from the body; draping a garment over the first shoulder portion and second shoulder portion; hanging the garment hanger from an object by engaging the object with the hook; removing the garment hanger from the object; and folding the garment hanger by rotating the hooking member relative to the body, wherein the body comprised a protrusion and wherein the method further comprising providing a second garment hanger having a body and a hooking member, the hooking member of the second garment hanger having a notch; and while the first garment hanger is hanging from the object, hanging the second garment hanger from the protrusion on the first garment hanger.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a garment hanger. In particular, the invention relates to an improved garment hanger with one or more improved features over conventional garment hangers. Although the garment hanger is illustrated and described in the context of being useful for holding a swimsuit or undergarment, the present invention can be useful in other instances, as will be apparent to one of ordinary skill in the art. Accordingly, the present invention is not intended to be limited to the examples and embodiments described herein.

Figure 1A:
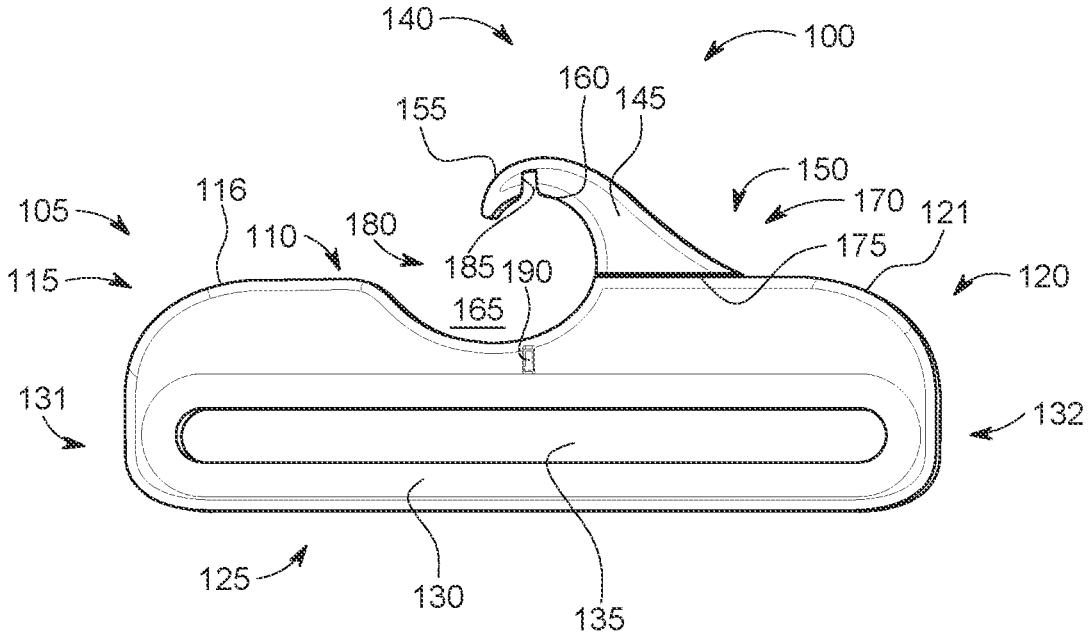
FIG. 1A is a schematic side view of a version of a garment hanger according to the invention.

FIG. 1A shows a garment hanger 100 according to one version of the invention. The garment hanger 100 is adapted to hold or contain a garment or other object for the purposes of display, storage, organization, drying, or the like. By garment it is meant any article of clothing, accessory, or any other object that is hangable from a garment hanger. By garment hanger it is meant any structure that is capable of containing or at least partially supporting a garment for the purpose of display, storage, organization, drying, or the like. The use of the term hanger is not meant to imply that the garment associated with the garment hanger is necessarily being hung or is even hangable, as further detailed hereinbelow. The garment hanger 100 has a body 105 that includes one or more features that help facilitate the holding of a garment on the garment hanger 100. For example, the body 105 has a top portion 110 that includes a first shoulder portion 115 having a first shoulder upper surface 116 and a second shoulder portion 120 having a second shoulder upper surface 121. The first shoulder portion 115 and second shoulder portion 120 serve to simulate human shoulders so that a garment that is worn around the shoulders, such as a shirt, jacket, scarf, or the like can be draped over the first shoulder portion 115 and the second shoulder portion 120 to simulate the wearing of the garment. In addition, the first shoulder portion 115 and the second shoulder portion 120 can be used to drape a garment that would not normally be worn on a user's shoulders, such as a belt, pants, underwear, non-clothing items or the like. By use of the term shoulder is it not meant to imply that a garment must be hung on the shoulder portion in a manner like it would hang from human shoulders when worn. Optionally, the body 105 can further include a cross bar portion 125 made up of a cross bar 130 that connects a first shoulder bottom section 131 to a second shoulder bottom section 132 in a manner that creates an interior space 135 between the cross bar 130 and the top portion 110 of the body 105.

The garment hanger 100 may include a hooking member 140 that extends upwardly and/or away from the top portion 110 of the body 105. Alternatively, the garment hanger 100 may be absent a hooking member or may have a hooking member that is removable or movable out of the way. In the version shown, the hooking member 140 has an arm 145 that extends from a connection mechanism 150 that connects the hooking member 140 to the body 105 to a hook 155. The hook 155 is a curved member having a rounded bottom surface 160. The arm 145 is sufficiently long to separate the bottom surface 160 of the hook 155 from the body 105 by a space 165 sized to receive an object, such as a bar or the like so that the hook 155 can extend around at least a portion of the object, and the bottom surface 160 may contact the object to hook the garment hanger 100 onto the object. This allows a garment that is held on the garment hanger 100 to be hooked onto the object.

Figure 1B:
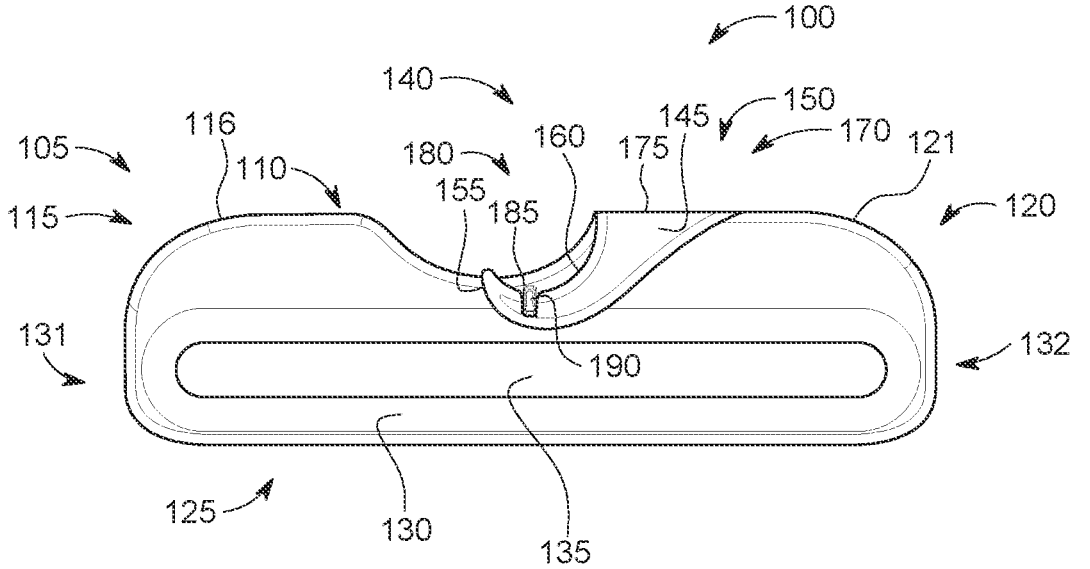
FIG. 1B is a schematic side view of the garment hanger of FIG. 1A in a folded configuration.

The garment hanger 100 in the version of FIG. 1A also includes a folding mechanism 170. The folding mechanism 170 includes a hinge mechanism 175 incorporated into the connection mechanism 150 that connects the arm 145 of the hooking member 140 to the body 105. The hinge mechanism 175 is designed to allow the arm 145 to rotate relative to the body about a hinge axis. The hinge axis is an axis that extends in a direction that is (i) generally in the direction of, and may be generally parallel to, a line connecting the first shoulder portion 115 and the second shoulder portion 120, (ii) generally parallel to at least a portion of the cross bar 130, (iii) and/or generally orthogonal to or perpendicular to a longitudinally extending bar from which the garment hanger 100 may be hooked when the garment hanger 100 is hooked onto the bar. In one version, hooking member 140 rotates about the hinge axis by an angle ranging from at least about 10 degrees to about 180 degrees. In the version shown in FIG. 1A, the hooking member 140 rotates by about 180 degrees so that the hooking member 140 can lie against or nearly against the body 105, as shown in FIG. 1B. In this manner, the garment hanger 100 can be moved from the unfolded configuration shown in FIG. 1A to the folded configuration shown in FIG. 1B by rotating the hooking member 140 about the hinge axis using the hinge mechanism 175. In the unfolded configuration, the garment hanger 100 can be used to hook onto a bar or the like. The garment hanger 100 can then be moved to the folded configuration for any of several purposes. For example, in the folded configuration, the garment hanger 100 can be more easily and compactly stored or shipped. Also, in the folded configuration, the garment hanger 100 can be used to display and/or store garments in a non-hanging manner, as will be further described hereinbelow.

In the particular version shown in FIGS. 1A and 1B, the body 105 is substantially flat or planar and the hooking member 140 is substantially flat or planar. By substantially flat or planar it is meant that at least a portion, typically a majority, lies substantially flat and within or along a plane, it being noted that curves, contours, extensions, and/or protrusions that cause a portion of the object to be slightly out of plane or that cause a small portion of the object to be out of plane does not prevent the object from being substantially flat or planar. In this version, in the unfolded configuration, the body 105 and the hooking member 140 are substantially coplanar with one another. Then, to move the garment hanger 100 into the folded position, the hooking member 140 is rotated out of the plane of the body, and the rotation is continued until the hooking member 140 is again substantially coplanar with the body 105 in the folded configuration. In the folded configuration, the hooking member 140 can lie substantially flat against the body 105 or can rotate to a position that is in a plane that is substantially parallel to the plane of the body 105. By substantially coplanar it is meant that the general plane of the body 105 and the general plane of the hooking member 140 are within about 10 degrees of one another. In another version, the planes may be within about 5 degrees of one another and in another version may be within about 2 degrees of one another.

Optionally, as shown in FIGS. 1A and 1B, the garment hanger 100 can include a securing mechanism 180 that helps maintain the garment hanger 100 in one or both of the unfolded configuration and the folded configuration. For example, in the version shown, the garment hanger 100 can include a notch 185 on the bottom surface 160 of the hook 155. The notch 185 is receivable on, around, or over a protrusion 190 or peg on the body 105 when in the folded configuration. The notch 185 and the protrusion 190 cooperate to help maintain the garment hanger 100 in the folded configuration. This can be performed by friction fit, snap fit, or the like. The securing mechanism 180 can be designed to allow the hooking member 140 to remain in the folded configuration until a predetermined amount of force is applied to unlatch the securing mechanism 180 and allow the hooking member 140 to return to the unfolded configuration. In an alternative system, the protrusion may be provided on the hook 155 and the notch provided on the body 105 or a different type of system, such as a snap, hook and loop fasteners, a magnetic system, and/or the like can be provided.

Figure 2A:
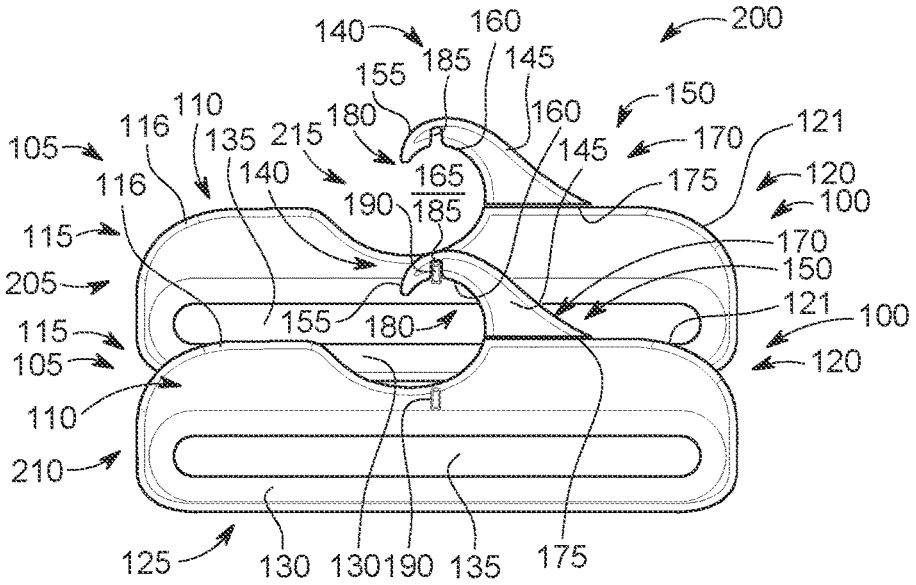
FIG. 2A is a schematic side view of a garment hanger system showing a plurality of garment hangers of FIG. 1A in a cascading configuration.

FIG. 2A illustrates a garment hanger system 200 made up of a plurality of garment hangers 100. With the garment hanger system 200, the garment hangers 100 can hang from one another in a cascading configuration. By cascading configuration it is meant that a first garment hanger 205 can be hung from a bar or other similar fixed object and a second garment hanger 210 can be hung from the first garment hanger 205. Optionally, a third garment hanger can be hung from the second garment hanger, etc. A cascading system 215 can be provided to facilitate the ease and orientation of the cascading of the garment hanger system 200. In the version of FIG. 2A, the cascading system 215 includes the notch 185 in the hook 155 and the protrusion 190 on the body 105. In use, the notch 185 of the second garment hanger 210 is attached or hung from to the protrusion 190 of the first garment hanger 205. The notch 185 may merely hang from the protrusion 190 or may be more securely attachable thereto, such as by a friction fit, snap, clip, hook and loop, magnet, or the like type of arrangement. As is apparent, in one version of the garment hanger system 200, the first garment hanger 205 can be provided without the notch 185, and the second garment hanger 210, or at least the lower-most garment hanger when there are more than two cascading hangers, can be provided without the protrusion 190. However, in a preferred version, both the first garment hanger 205 and the second garment hanger 210 and any additional garment hangers provided in the garment hanger system 200 will include both the notch 185 and the protrusion 190 so that the garment hangers can be used interchangeably.

In the version of FIG. 2A, the cascading system 215 uses the same notch 185 and protrusion 190 that is used in the securing mechanism 180 for the folding mechanism 170. This allows for each of the garment hangers 100 in the garment hanger system 200 be to used in multiple manners and in either the unfolded configuration or the folded configuration. For example, the first garment hanger 205 and the second garment hanger 210 can each be hung separately from a bar or the like, can each be cascaded from one another, or can each be folded into the folded configuration. Alternatively, the cascading system 215 can be separate from the securing mechanism 180 or can be provided on garment hangers that do not include a folding mechanism. When no folding mechanism 170 is present, the protrusion 190 can be provided at any desired location on the body 105 of the garment hanger 100. In one version, the protrusion 100 is provided on or near the center line of the garment hanger 100 to provide an even distribution of the weight on the first garment hanger 205. Alternatively, the protrusion 190 can be offset from the center line, for example when tilt is desired or when the garment hanger 100 may be carrying an unevenly distributed weight.

Figure 2B:
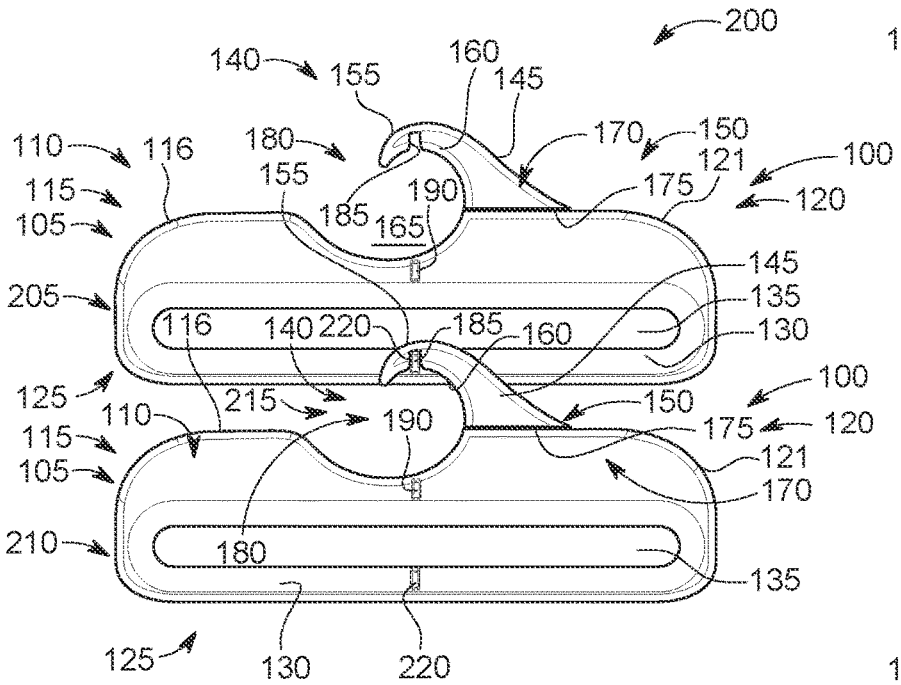
FIG. 2B is a schematic side view of another version of a garment hanger system showing a plurality of garment hangers in a second cascading configuration.

Optionally, a second protrusion 220 can be provided, as shown in the version of FIG. 2B. In this version, the first protrusion 190 is provide on the top portion 110 of the body 105 and a second protrusion 220 is provided on the cross bar 130. By providing the second protrusion 220, a user has an option as to how to arrange the cascading configuration. For example, the first garment hanger 205 and the second garment hanger 210 can be tightly cascaded by using the first protrusion 190 or can be more loosely cascaded by using the second protrusion 220. Cascading from the second protrusion 220 allows the garments to be more easily seen whereas cascading from the first protrusion is more compact. When more than two garment hangers 100 are provided in the garment hanger system 200, a user could have one or more garment hangers hanging from the first protrusion 190 of the garment hanger above it and can have one or more garment hangers hanging from the second protrusion 220.

Figure 2C:
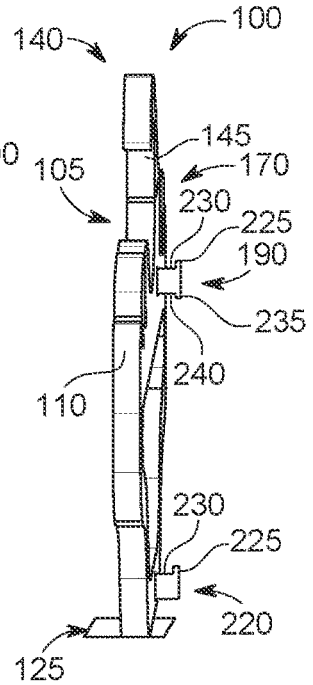
FIG. 2C is a schematic side view of the version of a garment hanger shown in FIG. 2B.

FIG. 2C shows a side view of a version of the garment hanger 100 of FIG. 2B. In the version of FIG. 2C, it can be seen that the first protrusion 190 and/or the second protrusion 220 can be provided with an upper lip 225 and an associated recess 230 to help secure the notch 185 thereon. Optionally, the notch 185 and recess 230 can have cooperating shapes that help to present rotation or swinging of a garment hanger 100 relative to another garment hanger 100, such as by having one or more flat mating surfaces. In addition, in the version shown, the first protrusion 190 can be provided with a lower lip 235 and associated recess 240 to help secure the notch 185 of its own garment hanger 100 when in the folded configuration.

Figure 3A:
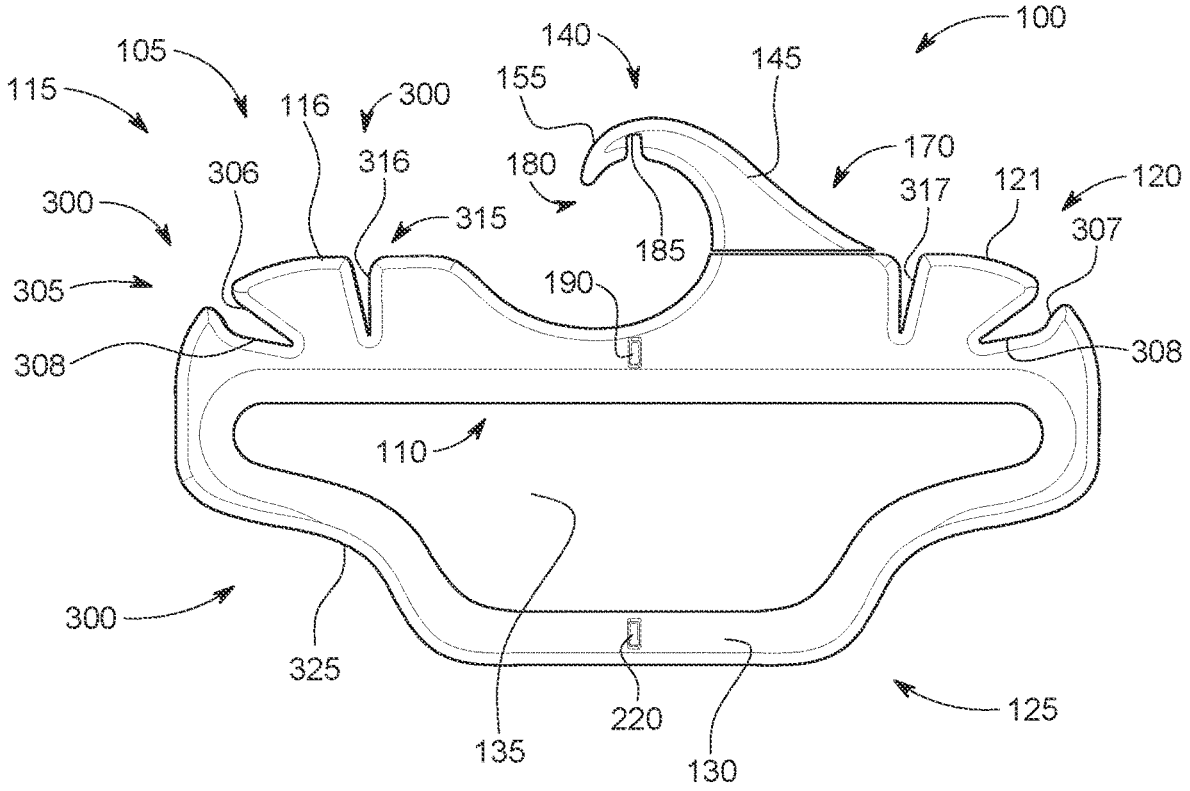
FIG. 3A is a schematic side view of another version of a garment hanger of the invention.
Figure 3B:
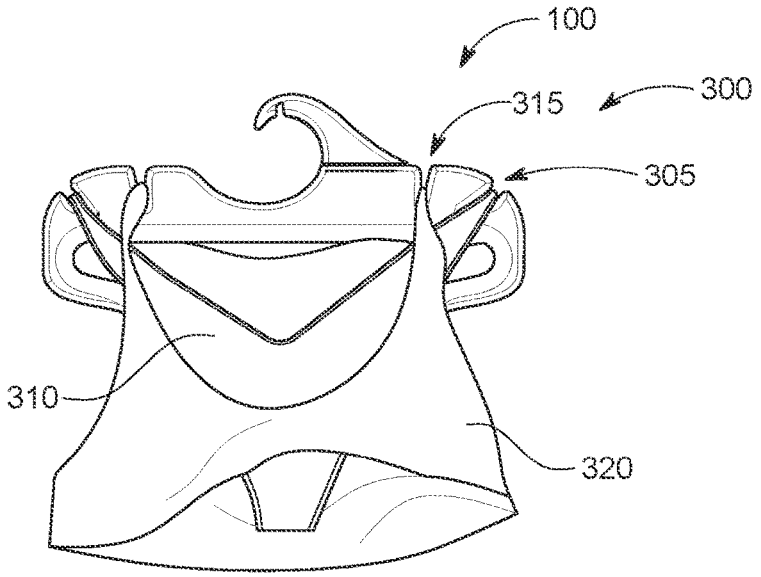
FIG. 3B is a schematic side view of the garment hanger of FIG. 3A with a swimsuit bottom and top thereon.

FIG. 3A shows a version of the garment hanger 100 of the invention with the body 105 of the garment hanger 100 designed to be particularly useful for hanging or storing one or more pieces of a two-piece garment, such as a two-piece swimsuit or two-piece undergarment set. By two-piece garment it is meant any garment that is designed to be worn as a matching or an unmatching set but that has a separable top designed to be worn around the chest and bottom designed to be worn around the waist and/or upper thigh. The garment hanger 100 of the version of FIG. 3A includes one or more features 300 that help in the attachment, organization, display, or drying of the one or more pieces of the two-piece garment. For example, one of the features 300 that may be provided is a pair of bottom piece slots 305. The bottom piece slots 305 are slots comprising a first slot 306 formed into the top surface 116 of the first shoulder portion 115 and a corresponding second slot 307 formed into the top surface 121 of the second shoulder portion 120. As shown in FIG. 3B, the bottom piece slots 305 are sized, shaped, and spaced to advantageously hold a bottom piece 310 of a two-piece garment, such as by securing the waist portion or straps associated with the waist portion within the bottom piece slots 305. Optionally, the bottom piece slots 305 can includes a flattened portion 308 extending at an angle relative to the outer portion of the slots 305. The flattened portion 308 is designed to receive a waist portion of the bottom piece 310. Additionally or alternatively, one of the features 300 may be a pair or top piece slots 315. The top piece slots 315 are slots comprising a first slot 316 formed into the top surface 116 of the first shoulder portion 115 and a corresponding second slot 317 formed into the top surface 121 of the second shoulder portion 120. As shown in FIG. 3*b*, the top piece slots 315 are sized, shaped, and spaced to advantageously hold the straps of a top piece 320 of a two-piece garment, such as by securing the shoulder straps of the top piece 320 within the top piece slots 315. In one version, the garment hanger 100 includes both the bottom piece slots 305 and the top piece slots 315 so that both the bottom piece 310 and the top piece 320 of the two-piece garment can be stored or displayed on the same garment hanger 100. The top piece slots 315 are also designed to get narrower relative to one another as they extend into the body 105 to allow the garment to be fixed in place with a camming action. The bottom piece slots 305 and the top piece slots 315 are also provide with smooth rounded edges to help prevent damage to the garment.

Optionally, one of the features 300 may additionally be hip contour 325 that includes an inwardly extending portion of the cross bar portion 125. The hip contour 325 provides space for excess material that would otherwise be pulled or stretched without the contour. The hip contour 325 can take on other shapes that accomplish a similar goal or may be removed.

Figure 4A:
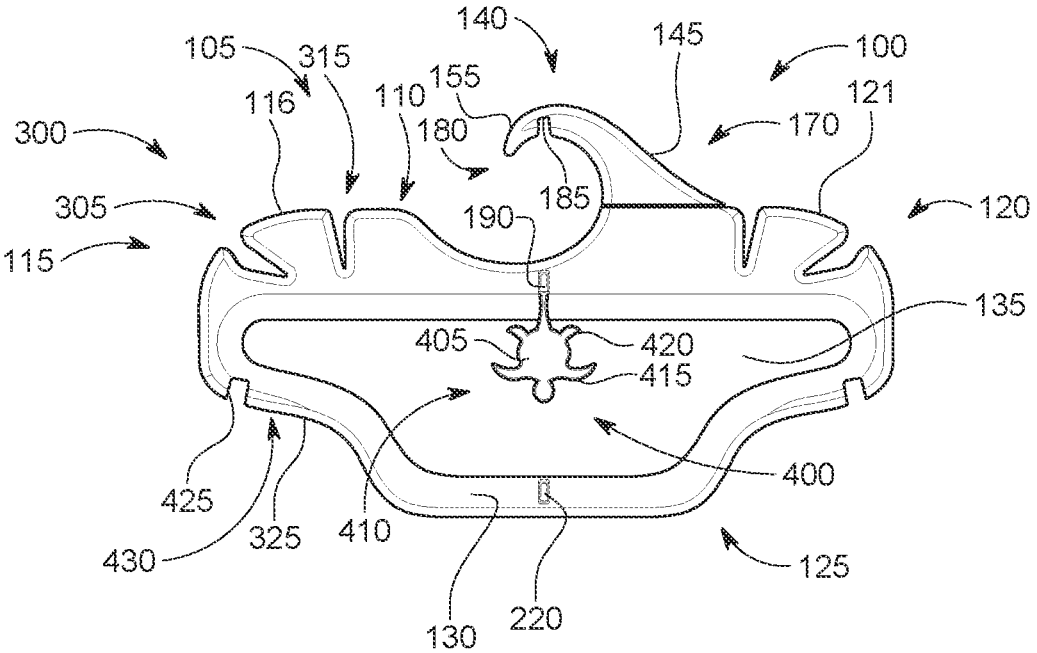
FIG. 4A is a schematic side view of another version of a garment hanger of the invention.
Figure 4B:
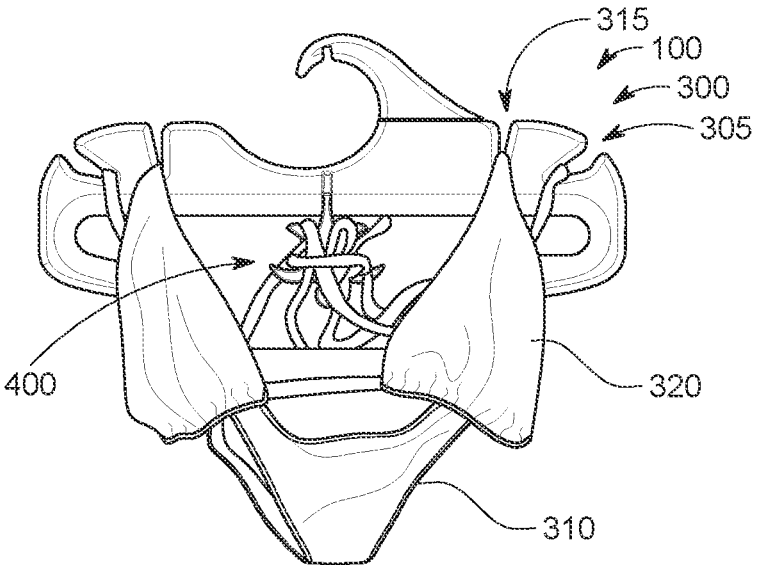
FIG. 4B is a schematic side view of the garment hanger of FIG. 4A with a two-piece swimsuit thereon with swimsuit strings secured.

FIG. 4A shows a version of a garment hanger 100 similar to the version of FIG. 3A, but with an additional string organizing member 400 provided. In the version shown, the string organizing member 400 is positioned within the interior space 135. The string organizing member 400 includes a body portion 405 around which strings from the garment being hung on the garment hanger 100 can be secured. Optionally, one or more wings 410 can extend outwardly from the body portion 400 to provide additional contours for securing the strings. In the particular version of FIG. 4A, the wings 410 include a lower set of wings 415 and an upper set of wings 420. This arrangement allows for multiple and various options for the tying of the strings, as shown in FIG. 4B. Optionally, additional organization features, such as baskets, clips, elastic straps or bands, or the like can also be provided.

The garment hanger system 200 can be used to display a plurality of garments. For example, the garment hangers 100 can each holding both pieces of a two-piece garment which can be hung in a cascading configuration with the notch 185 of the second garment hanger 210 hanging from the protrusion 190 of the first garment hanger 205 and similarly showing a third garment hanger 500 hanging from the second garment hanger 210. Alternatively, the cascading configuration can have the garment hangers 100 hanging in a second cascading configuration with the notch 185 of the second garment hanger 210 hanging from the second protrusion 220 of the first garment hanger 205.

Figure 5:
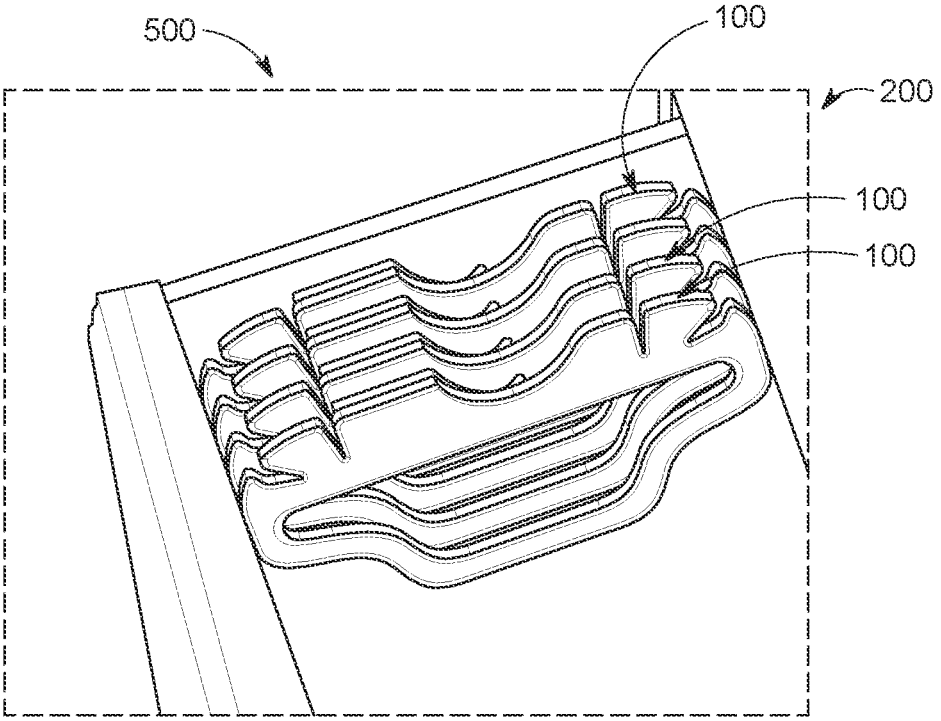
FIG. 5 is a schematic perspective view of plurality of garment hangers of FIG. 4A in a folded configuration being stored.

FIG. 5 shows a storage system 500 for a garment hanger system 200 with a plurality of garment hangers 100, such as the one shown in FIG. 4A, each folded into its folded configuration and stored side by side in a drawer or other compartment. FIG. 5 shows the storage system 500 and the garment hanger system 200 of FIG. 3A with each garment hanger 100 empty. The storage system 500 can also be used to store garment hangers that are holding a garment, such as those shown in FIGS. 3B and 4B. The storage system 500 thus allows the pieces of a two-piece garment to be stored together in an easily visible manner where each set can be easily removed from and returned to the storage system 500. In one version, the bottom of the garment hanger 100 is flat so that the garment hangers can stand in a drawer or other compartment.

As also optionally shown in FIG. 4A, a version of a garment hanger 100 that is particularly useful with a particular type of storage system 500 having rails, such as filing cabinet rails, is shown. In this version, the garment hanger 100 includes a hanging system that includes a pair recesses 425 positioned on the body 105 of the garment hanger 100. For example, in the version of FIG. 4A, the recesses 425 can be provided on the bottom surface 430 of the cross bar portion 125 or elsewhere on the bottom of the garment hanger 100. The recesses 425 mimic the recesses of a file folder so that the garment hanger 100 can be suspended on the rails of a conventional filing system.

The garment hanger 100 of the invention may be made of any suitable material and sized to suit any intended purposed. For example, the garment hanger 100 may be made of one of more of plastic, acrylic, cardboard, paper, rubber, glass, metal, wood, and the like. In the version shown and designed to be used with adult size two-piece garments, the garment hanger 100 can have a length of from about 6 inches to about 16 inches, and in one version is about 13.25 inches, a height from about 4 inches to about 14 inches, and in one version is about 7.75 inches, and a thickness from about 0.06 inches to about 0.75 inches, and in one version is about 0.6 inches. Alternatively, in another version designed to be used with child size garments, the garment hanger 100 can have a length of from about 4 inches to about 14 inches, and in one version is about 9.25 inches, a height from about 3 inches to about 12 inches, and in one version is about 6.25 inches, and a thickness from about 0.06 inches to about 0.75 inches, and in one version is about 0.6 inches. Any combination of the above dimensions can also be used.

Though certain features of the garment hanger 100 have been described as being particularly useful for the storage, display, organization, and/or drying of a two-piece garment, other garments or other items can also be used with the garment hanger 100. For example, a one-piece swimsuit or undergarment can be easily used on the garment hanger 100 using the top piece slots 315 to hang the shoulder straps of the one-piece garment. Also, it has been found that the garment hanger 100 is useful for storing and/or drying men's swimwear by using the bottom piece slots 305. Other types of garments can also be used.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/−ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A garment hanger adapted to hold a garment, the garment hanger comprising:

a body having a top portion comprising a first shoulder portion and a second shoulder portion;

a hooking member including an arm that extends away from the body to a hook that can be hooked on an object;

a connection mechanism that connects the hooking member to the body, the connection mechanism comprising a hinge mechanism that allows the hooking member to be rotated towards and away from the body, wherein the connection mechanism allows the hooking member to be rotated to move the garment hanger from an unfolded configuration to a folded configuration;

a securing mechanism that secures the hooking member in the folded configuration, wherein the securing mechanism comprises a notch on the hooking mechanism and a protrusion on the body, the protrusion being sized and shaped to engage the notch; and a cross bar that connects the first shoulder portion to the second shoulder portion, wherein a second protrusion is provided on the cross bar, the second protrusion being sized and shaped to engage another garment hanger.

2. A garment hanger according to claim 1 wherein the connection mechanism allows the hooking member to be rotated to move the garment hanger from an unfolded configuration to a folded configuration, wherein in the unfolded configuration, the garment hanger can be hung from an object.

3. A garment hanger according to claim 1 wherein the body is substantially planar and wherein the hooking member is substantially planar and wherein the connection mechanism allows the hooking member to be moved from a first configuration where the body and the hooking member are substantially coplanar to a position where the body and the hooking member are out of plane.

4. A garment hanger according to claim 1 wherein the body is substantially planar and wherein the hooking member is substantially planar and wherein the connection mechanism allows the hooking member to be rotated from an unfolded configuration where the body and the hooking member are substantially coplanar to a position where the body and the hooking member are out of plane and then to a folded configuration where the body and the hooking member are again substantially coplanar.

5. A garment hanger according to claim 1 wherein the hinge mechanism has a hinge axis about which the hooking member rotates, the hinge axis extending substantially in a direction of a line connecting the first shoulder portion and the second shoulder portion.

6. A garment hanger according to claim 1 wherein the hook is adapted to be hung on a longitudinally extending bar, and wherein the hinge mechanism has a hinge axis about which the hooking member rotates, the hinge axis extending substantially in a direction orthogonal to the bar when the garment hanger is hung thereon.

7. A garment hanger according to claim 1 wherein a cross bar connects the first shoulder portion to the second shoulder portion and wherein the hinge mechanism has a hinge axis about which the hooking member rotates, the hinge axis extending substantially parallel to the cross bar.

8. A garment hanger according to claim 1 wherein the second protrusion is sized and shaped substantially the same as the protrusion of the securing mechanism.

9. A garment hanger according to claim 8 wherein the garment hanger is part of a garment hanger system comprising a second garment hanger having a body and hooking member, the hooking member of the second garment hanger having a notch adapted to engage either protrusion of the first garment hanger.

10. A garment hanger according to claim 1 wherein the first shoulder portion and the second shoulder portion each comprise a slot adapted to receive a portion of a garment to be held by the garment hanger, wherein the slot has a contour that provides camming action.

11. A garment hanger according to claim 1 wherein the body comprises an organizing member that extends downwardly from the top portion, the organizing member being adapted to contain a portion of a garment to be held by the garment hanger.

12. A garment hanger adapted to hold a garment, the garment hanger comprising:

a body having a top portion comprising a first shoulder portion, a second shoulder portion, and a protrusion;

a hooking member including an arm that extends away from the body to a hook that has a bottom surface that can be hooked on an object, the hooking member including a notch that extends into the bottom surface; and a connection mechanism that connects the hooking member to the body, wherein the notch and protrusion are sized and shaped to be engageable with one another.

13. A garment hanger according to claim 12 wherein the connection mechanism comprising a hinge mechanism that allows the hooking member to be rotated towards and away from the body so that the notch and protrusion can engage one another.

14. A garment hanger according to claim 12 wherein the garment hanger is part of a garment hanger system comprising a second garment hanger having a body and hooking member, the hooking member of the second garment hanger having a notch adapted to engage the protrusion of the first garment hanger.

15. A garment hanger according to claim 12 wherein a cross bar connects the first shoulder portion to the second shoulder portion and wherein a second protrusion is provided on the cross bar, the second protrusion being sized and shaped to be engageable with the notch.

16. A method of hanging one or more garments from a garment hanger system, the method comprising:

providing a first garment hanger comprising a body having a top portion comprising a first shoulder portion and a second shoulder portion; a protrusion on the body; a hooking member including an arm that extends away from the body to a hook that can be hooked on an object; and a connection mechanism that connects the hooking member to the body, the connection mechanism comprising a hinge mechanism that allows the hooking member to be rotated towards and away from the body;

draping a garment over the first shoulder portion and second shoulder portion;

hanging the garment hanger from an object by engaging the object with the hook;

providing a second garment hanger having a body and a hooking member, the hooking member of the second garment hanger having a notch;

while the first garment hanger is hanging from the object, hanging the second garment hanger from the protrusion on the first garment hanger;

removing the first garment hanger from the object; and folding the first garment hanger by rotating the hooking member relative to the body.

17. A method according to claim 16 wherein the second garment hanger is removed from the protrusion before folding the first garment hanger.

18. A method according to claim 17 wherein the first garment hanger has a notch and wherein when the first garment hanger is folded the notch of the first garment hanger engages the protrusion.

19. A method according to claim 17 wherein the first garment hanger has a notch and a second protrusion, and wherein when the first garment hanger is folded the notch of the first garment hanger engages one of the protrusions.

20. A method according to claim 19 wherein the second garment hanger can be hung from either protrusion of the first garment hanger.

* * * * *